US008795506B2

(12) United States Patent
Powell, IV et al.

(10) Patent No.: US 8,795,506 B2
(45) Date of Patent: Aug. 5, 2014

(54) PRIMARY PRODUCTION OF ELEMENTS

(71) Applicant: Infinium, Inc., Natick, MA (US)

(72) Inventors: Adam C. Powell, IV, Newton, MA (US); Stephen J. Derezinski, Wellesley, MA (US)

(73) Assignee: Infinium, Inc., Natick, MA (US)

( * ) Notice: Subject to any disclaimer, the term of this patent is extended or adjusted under 35 U.S.C. 154(b) by 0 days.

(21) Appl. No.: 13/913,745

(22) Filed: Jun. 10, 2013

(65) Prior Publication Data

US 2013/0264212 A1 Oct. 10, 2013

Related U.S. Application Data

(62) Division of application No. 12/764,637, filed on Apr. 21, 2010, now Pat. No. 8,460,535.

(60) Provisional application No. 61/174,395, filed on Apr. 30, 2009.

(51) Int. Cl.
*C25B 1/00* (2006.01)
*C25B 15/02* (2006.01)

(52) U.S. Cl.
USPC ..... 205/354; 205/410; 205/915

(58) Field of Classification Search
USPC ..... 205/354, 410
See application file for complete search history.

(56) References Cited

U.S. PATENT DOCUMENTS 3,219,561 A 11/1965 Monnier et al.
3,254,010 A 5/1966 Monnier et al.
3,983,012 A 9/1976 Cohen
4,142,947 A 3/1979 Cohen
4,292,145 A 9/1981 De Mattei et al.
4,588,485 A 5/1986 Cohen et al.
4,923,579 A * 5/1990 Snyder et al. ..... 205/370
5,976,345 A 11/1999 Pal et al.
6,896,788 B2 5/2005 Shindo et al.
7,435,325 B2 10/2008 Shindo et al.
7,744,734 B2 6/2010 Li (Continued)

FOREIGN PATENT DOCUMENTS

EP 0156744 A1 10/1985
JP 62161985 7/1987

(Continued)

OTHER PUBLICATIONS

"Notification of Transmittal of the International Search Report and the Written Opinion of the International Searching Authority, or the Declaration," International Filing Date: Apr. 29, 2010, International Application No. PCT/US2010/001263,Applicant: Metal Oxygen Separation Technologies, Inc., Date of Mailing: Jul. 12, 2010, pp. 1-10.

(Continued)

*Primary Examiner* — Bryan D. Ripa
(74) *Attorney, Agent, or Firm* — Wilmer Cutler Pickering Hale and Dorr LLP

(57) ABSTRACT

Electrowinning methods and apparatus are suitable for producing elemental deposits of high quality, purity, and volume. Respective cathodes are used during electrowinning for bearing the elemental product, segregating impurities, dissolving morphologically undesirable material, and augmenting productivity. Silicon suitable for use in photovoltaic devices may be electrodeposited in solid form from silicon dioxide dissolved in a molten salt.

7 Claims, 8 Drawing Sheets

(56) References Cited

U.S. PATENT DOCUMENTS

| | | | | |
|---|---|---|---|---|
| 8,460,535 | B2 | 6/2013 | Powell, IV et al. | |
| 2006/0185984 | A1* | 8/2006 | Nguyen et al. | 205/388 |
| 2007/0031608 | A1 | 2/2007 | Webb et al. | |
| 2007/0215483 | A1 | 9/2007 | Johansen et al. | |
| 2009/0000955 | A1 | 1/2009 | Pal | |

FOREIGN PATENT DOCUMENTS

| | | | |
|---|---|---|---|
| JP | 070300692 | | 11/1995 |
| JP | 11060398 | | 3/1999 |
| JP | 2000219990 | A | 8/2000 |
| JP | 2001040493 | A | 2/2001 |
| JP | 2002098793 | A | 4/2002 |
| JP | 2002285371 | A | 10/2002 |
| JP | 2004083992 | A | 3/2004 |
| JP | 2005314742 | A | 11/2005 |
| JP | 2007016293 | A | 1/2007 |
| WO | WO-98/30738 | A2 | 7/1998 |
| WO | WO-02/077325 | A1 | 10/2002 |
| WO | WO-2006/037999 | A2 | 4/2006 |

OTHER PUBLICATIONS

De Mattei, Robert C., et al., "Electrodeposition of Silicon at Temperatures Above Its Melting Point," Journal of Electrochemistry Soc.: Electrochemical Science and Technology, vol. 128 No. 8, Aug. 1981, pp. 1712-1714.

Elwell, D., et al., "Electrolytic Production of Silicon," Reviews of Applied Electrochemistry 18, Journal of Applied Electrochemistry, vol. 18, 1988, pp. 15-22.

Elwell, Dennis, et al., "Electrodeposition of Solar Silicon," Solar Energy Materials, vol. 6, North-Holland Publishing Company, 1982, pp. 123-145.

Elwell, Dennis, et al., "The Morphology of Silicon Electrodeposits on Graphite Substrates,"Journal of Electrochemistry Soc.: Electrochemical Science and Technology, vol. 130 No. 5, May 1983, pp. 1021-1025.

Fray, Derek J. "Emerging Molten Salt Technologies for Metals Production," JOM, Oct. 2001, pp. 26-31.

Huggins, R. A., et al., "Morphological Stability of a Plane Interface During Electrocrystallization from Molten Salts," Journal of Crystal Growth, vol. 37, North-Holland Publishing Company, 1977, pp. 159-162.

Jin, Xianbo, et al., "Electrochemical Preparation of Silicon and Its Alloys from Solid Oxides in Molten Calcium Chloride," Angewandte Chemie International, Ed. 2004, vol. 43, Wiley-VCH Verlag GmbH & Co. KGaA, Weinheim, 2004, pp. 733-736.

Krishnan, Ajay, et al., "Solid Oxide Membrane (SOM) Technology for Environmentally Sound Production of Tantalum Metal and Alloys from Their Oxide Sources," Scandinavian Journal or Metallurgy, vol. 34, Blackwell Publishing, Feb. 21, 2005, pp. 293-301.

Mogi, Iwao, et al., "Suppression of Growth Instability in Electropolymerization of Pyrrole," Bull. Chem. Soc. Jpn., vol. 69 No. 7, Jan. 23, 1996, pp. 1889-1892.

Monnier, Robert, "L'Obtention et le Raffinage du Silicium par Voie Electrochimique," Chimia 37 (1983) Nr. 4, Apr. 1983, pp. 109-123.

Moore, J. T., et al., "Fused-Salt Electrodeposition of Thin-Layer Silicon," IEEE, 26.sup.th PVSC, Anaheim, California, Sep. 30, 1997 to Oct. 3, 1997, pp. 775-778.

Palaniappa, M., et al., "Double Step Chronocoulometric Studies on Industrial Copper Alloy in Acidic Copper Sulfate Electrolytic Solutions—Part II," International Journal of Electrochemical Science, vol. 3, Mar. 20, 2008, pp. 656-665.

Rao, Gopalakrishna, et al., "Electrodeposition of Silicon onto Graphite," Journal of Electrochemistry Soc.: Electrochemical Science and Technology, vol. 128 No. 8, Aug. 1981, pp. 1708-1711.

Rao, Gopalakrishna, et al., "Electrowinning of Silicon from K.sub. 2SiF.sub.6—Molten Fluoride Systems," Journal of Electrochemistry Soc.: Electrochemical Science and Technology, vol. 127 No. 9, Sep. 1980, pp. 1940-1944.

Suput, M., et al., "Solid Oxide Membrane Technology for Environmentally Sound Production of Titanium," TMS, vol. 117 No. 2, Published by Maney on behalf of the Institute and the AusIMM, Mineral Processing and Extractive Metallurgy (Trans. Inst. Min. Metall. C.), 2008, pp. 118-122.

Takasu, Tomio, et al., "Effect of Fluid Motion of Electrolyte on the Behaviors of V Group Elements (As, Sb, Bi) in Copper Electrorefining under High Current Density," Shigen-to-Sozai, vol. 115 No. 11, 1999, pp. 841-846.

Yasuda, Kouji, et al., "Direct Electrolytic Reduction of Solid SiO. sub.2 in Molten CaCl.sub.2 for the production of Solar Grade Silicon,"Elsevier Ltd., Electrochimica Acta, vol. 53, Jan. 16, 2007, pp. 106-110.

* cited by examiner

PRIMARY PRODUCTION OF ELEMENTS

CROSS-REFERENCE TO RELATED APPLICATIONS

The present application is a divisional of U.S. patent application Ser. No. 12/764,637, filed Apr. 21, 2010, entitled Primary Production of Elements, now U.S. Pat. No. 8,460,535, and claims the benefit of U.S. Provisional Patent Application Ser. No. 61/174,395, filed Apr. 30, 2009, entitled Method for Primary Production of High-Purity Metals, each of which is incorporated by reference herein.

BACKGROUND OF THE INVENTION

1. Field of the Invention

This invention relates to systems for electrowinning an element from a feedstock compound. In particular this invention relates to apparatus and methods for producing dense, high-purity elemental deposits.

2. Background Information

The implementation of silicon-based photovoltaic technology has grown significantly in recent years. Nevertheless, an economical way of producing silicon of sufficient purity for high-efficiency solar cells—at least 99.9999% pure—has remained somewhat elusive. Solar-grade silicon is conventionally obtained by first reducing silicon dioxide carbothermically, yielding metallurgical-grade silicon, which is on the order of 98% pure. The metallurgical-grade silicon is then converted to a volatile silicon compound that may be readily purified by distillation, for example silane, tetrachlorosilane or trichlorosilane. The silicon is recovered from the purified volatile silicon compound by exposing it to solid-phase silicon substrates at high temperature, provoking decomposition of the compound with deposition of high-purity silicon onto the substrate. The deposited silicon is better than solar grade, typically greater than 99.9999%. However, this purification sequence is energy intensive, multiplying the energy needed for fundamental reduction by several powers of ten. There is, accordingly, a need for a more cost-effective way to produce silicon of optimal purity for solar applications.

SUMMARY OF THE INVENTION

In one embodiment, a method of electrowinning an element from a compound includes providing a liquid electrolyte in which the compound is dissolved and an anode and a first cathode in electrical contact with the electrolyte. Electrons are extracted from the anode and provided to the first cathode, thereby depositing solid material including one or more impurities from the electrolyte onto the first cathode and depleting the electrolyte of the impurity. A second cathode is provided in electrical contact with the electrolyte. Electrons are extracted from the anode and provided to the second cathode, thereby depositing a solid product, at least 99% of which is the element, from the depleted electrolyte onto the second cathode.

In another embodiment, a method of electrowinning silicon from silicon dioxide, includes providing a liquid electrolyte of at least two metal fluorides constituting at least 60% by weight of the liquid electrolyte, silicon dioxide and aluminum oxide. An anode, separated from the liquid electrolyte by a membrane capable of conducting oxygen anions, is provided and a cathode is placed in the liquid electrolyte. Electrons are extracted from the anode and provided to the cathode, thereby depositing a solid material from the electrolyte onto the cathode. Silicon constitutes more than 50% of the deposited solid material by weight.

In another embodiment, a method of electrowinning an element from a compound includes providing a liquid electrolyte, in which the compound is dissolved, a cathode in electrical contact with the liquid electrolyte, and an anode separated from the liquid electrolyte by a membrane capable of conducting the ions from the electrolyte. A deposition-dissolution cycle is executed, which includes depositing a solid product, the element constituting at least 99% thereof, onto the cathode during a first interval by extracting electrons from the anode while providing electrons to the cathode; and electrodissolving a portion of the deposited solid product from the cathode and plating solid material comprising the element onto a counter cathode in contact with the liquid electrolyte during a second interval by electrically isolating the anode while extracting electrons from the cathode and providing electrons to the counter cathode.

In yet another embodiment, a method of electrowinning an element from a compound includes providing a liquid electrolyte, in which the compound is dissolved, and an anode, having an axis and a surface in electrical contact with the electrolyte. A plurality of cathodes are arranged around the anode at equal angular intervals and at respective equal distances from the anode. The cathodes have respective axes and respective surfaces in electrical contact with the electrolyte. The sum of the respective areas of the surfaces of the cathodes is at least four times the area of the surface of the anode. The anode and cathodes define a zone. The liquid electrolyte is stirred simultaneously around the respective cathodes while electrons are extracted from the anode while electrons are provided to the cathodes, thereby depositing a solid material including the element onto the surfaces of respective cathodes.

BRIEF DESCRIPTION OF THE DRAWINGS

The invention description below refers to the accompanying drawings, wherein identical reference symbols designate like structural or functional elements, and in which.

Features in the figures are not, in general, drawn to scale.

DETAILED DESCRIPTION OF AN ILLUSTRATIVE EMBODIMENT

Figure 1:
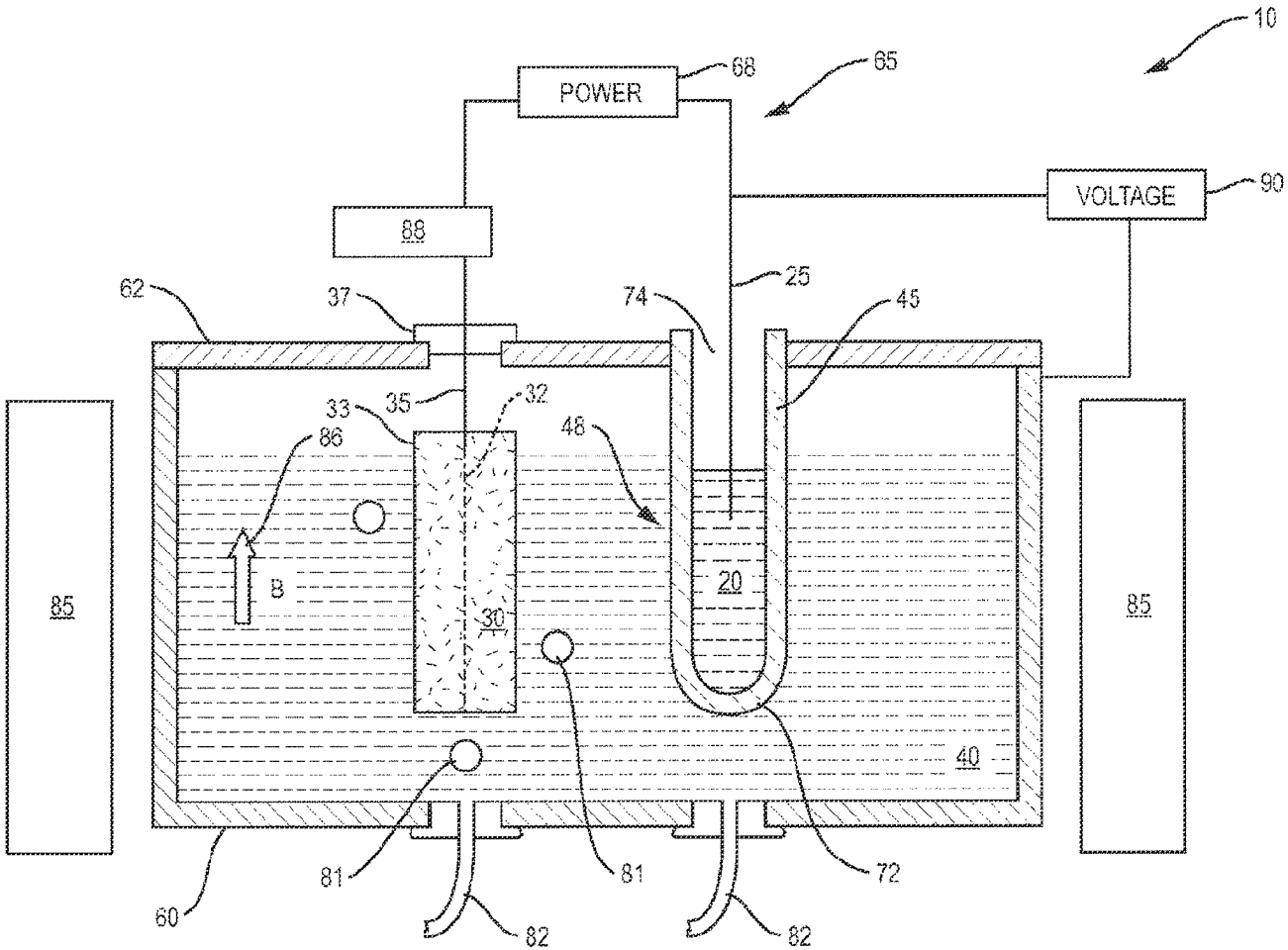
FIG. 1 is a schematic diagram of a silicon electrowinning system compatible with the invention in which the vessel is shown in cross section.

With reference to FIG. 1, in an illustrative embodiment, an electrowinning system 10, configured for direct production of a target element, silicon, from a feedstock compound, silicon dioxide, includes an anode 20, a cathode 30 and an intervening liquid electrolyte 40 in which the feedstock compound is dissolved. The anode 20 is separated from the electrolyte 40 by an ionically conductive membrane 45. The electrolyte 40 is contained by a vessel 60 covered by a lid 62. An exterior circuit 65 is configured to receive electrons from the anode 20 and to deliver electrons to the cathode 30 during operation of the system 10. The electrolyte 40 and the electrodes 20 and 30 may be maintained at an operating temperature below the melting temperature of silicon (1414° C.), illustratively around 900° C. to 1300° C.

The exterior circuit 65 includes a power supply 68 which may be a DC voltage source operable to apply sufficient voltage across the anode 20 and the cathode 30 to cause decomposition of the feedstock compound in the electrolyte 40. Alternatively, the power supply 68 may be a DC current source operable to drive electrolysis of the feedstock compound at a desired rate.

The anode 20 is constituted to support an oxidation reaction that is part of the overall feedstock compound decomposition that occurs electrolytically during operation of the system 10. Accordingly, the anode 20 may be of a material on which oxygen-bearing anions are oxidized and form gaseous oxygen, such as liquid silver, or a porous electronically-conducting oxide, for example, lanthanum strontium manganate. In another approach the anode 20 may be a metal such as liquid tin and configured with an apparatus (not shown) for bubbling a gas reactive with oxygen at the operating temperature, such as hydrogen or natural gas, through the anode 20. An anode lead 25 connects the anode to the exterior circuit 65.

The membrane 45 is capable of conducting ions between the electrolyte 40 and the anode 20 in support of the oxidation reaction at the anode 20 during electrolysis in the vesse 160. The membrane 45 is illustratively of yttria-stabilized zirconia ("YSZ") or some other oxygen anion conductor. The anode 20 and oxide membrane 45 together are herein referred to as the solid-oxide membrane ("SOM") anode 48. Variations of the SOM anode 48 are given in U.S. Pat. No. 5,976,345 and U.S. Patent Application Publication 2009/0000955, both incorporated herein by reference in their entireties.

Illustratively the membrane 45 in the SOM anode 48 is configured as a cylindrical tube having a closed end 72 holding the anode 20. The tube is seated through the lid 62 with an open end 74 venting to the exterior of the vessel 60 to allow the escape of gaseous products of the anodic reaction. The membrane 45 serves to shield the anode 20 from the aggressive chemical environment of the molten electrolyte 40. Accordingly, a range of nonconsummable alternatives to carbon may be used for the anode 20 in the system 10, affording production of an element such as silicon without carbon emissions.

The membrane 45 forming the tube may be on the order of 0.25 cm thick. The tube may be about 1 to 3 cm in diameter and on the order of 20 to 60 cm long. The length of the tube may be limited practically by the need for oxygen bubbles, which nucleate along the entire length of the tube, to escape without excessive distribution of the liquid metal anode 20 during electrolysis in the vessel 60. It is expected that an SOM anode comprising a liquid silver anode in an yttria-stabilized zirconia tube having dimensions in these ranges may support anode currents on the order of about 1 A/cm$^2$ in a molten salt environment without degradation due to thermal stresses arising from ohmic heating or mechanical stresses due to bubble movement.

The cathode 30 is constituted to support a reduction reaction that is part of the overall silicon oxide decomposition occurring electrolytically in the system 10 and to bear a resulting accumulation of the silicon product. Accordingly, initially, i.e., before electrolysis, the cathode 30 has a solid surface 33 that is conducive to deposition thereon of silicon, illustratively preferentially to other elements present in the electrolyte 40. For example, the composition of the cathode 30 may be such that silicon constitutes 50%, 70%, 90% or more of the cathode 30 at the surface 33 initially. The cathode 30 may be a solid silicon body, for example a Czochralski-grown single silicon crystal. Illustratively the cathode 30 is a cylindrical rod having an initial diameter of about 1 to 3 cm. The length of the cathode 30 may be on the order of 30 to 60 cm. A cathode lead 35 connects the cathode 30 to the exterior circuit 65 through the lid 62.

The liquid electrolyte 40 is constituted to dissolve the feedstock compound at the operating temperature of the system 10 as well as for other properties. For example, the electrolyte 40 may be formulated for low vapor pressure; low electronic conductivity and sufficient ion mobility for adequate diffusivities and conductivities; and low viscosity, less than about 1 poise. Ideally the electrolyte 40 is chemically compatible with other constituents of the system 110 such as the membrane 45 and vessel 60 and does not contain reducible species bearing elements more electronegative than the target element.

Illustratively the electrolyte 40 is a mixture of metal halides combined with silicon dioxide and one or more additives. Silicon dioxide may constitute 5%, 10%, 15% or greater of the electrolyte 40 by weight. The metal halides may constitute at least about 60% of the electrolyte 40 by weight. In one embodiment, the metal halides include two or more metal fluorides such as alkaline earth metal fluorides. For example, the electrolyte 40 may include the eutectic mixture of about 38 wt % $CaF_2$-62 wt % $BaF_2$, which melts at approximately 1020° C. In another embodiment, the electrolyte 40 may include the eutectic mixture of about 39 wt % $CaF_2$-61 wt % $MgF_2$, which melts at about 980° C. In yet another embodiment, the metal halides in the electrolyte 40 include metal chlorides.

It has been discovered that the presence of aluminum oxide in metal halide melts, particularly in fluorides, reduces the vapor pressure of silicon halides formed in situ. Illustratively the electrolyte 40 includes aluminum oxide, thereby reducing evaporative loss of silicon from the electrolyte 40 at the operating temperature. Aluminum oxide may constitute about 5%, 7%, 10%, 12% or more of the electrolyte 40 by weight.

The operating temperature is chosen in view of the properties of the anode 20, membrane 45, cathode, 30 and electrolyte 40. Considerations of electrical conductivity in constituents of the system 10 favor operation closer to the melting temperature of the target element, silicon. On the other hand, volatile elements in the electrolyte 40, for example $SiF_4$ may become more difficult to contain at higher operating temperatures in the 900-1300° C. range, for example temperatures greater than 1050° C. An operating temperature range in the range 950° C. to 1150° C. may represent a viable compromise between factors of electrolyte chemistry and electrode conductivity.

The vessel 60 and lid 62 are constituted to form a gas-tight enclosure. The system 10 may include apparatus (not shown) for backfilling the headroom above the electrolyte 40 with an inert gas such as argon or nitrogen. Techniques and materials ancillary to confining molten salts and their vapors at elevated temperatures in a container such as the vessel 60 with an apertured cover such as the lid 62 and techniques for achieving and maintaining operating temperatures of molten constituents such as the electrolyte 40 are known to those skilled in the art.

The vessel 60 is of a material compatible with the chemistry of the electrolyte 40, so that vessel-electrolyte interactions cause minimal degradation of the integrity of the vessel 60 or contamination of the electrolyte 40. The vessel 60 may be of an electrically conductive material. For containing an electrolyte 40 of halide salts and oxides, a stainless or, preferably, mild carbon steel may be serviceable. Nonetheless, cations, for example of iron, may leach from steel into the electrolyte 40 and ultimately deposit onto the cathode 30 with the target element. A DC voltage supply 90 is configured to maintain the vessel 60 at a cathodic potential compared to the anode 20 to inhibit such deleterious anodic reactions on the interior surface of the vessel 60.

The system 10 may be equipped to agitate the liquid electrolyte 40 by one or more methods to promote compositional uniformity in the liquid and reduce diffusion effects in the vessel 60 during operation. Gas bubbles 81 may be forced through the electrolyte 40, for example by bottom-blowing tuyeres 82 aligned with the anode 20 and the cathode 30. Exterior magnets 85 may be situated to apply a vertically oriented DC magnetic field 86, which interacts with the current from anode 20 to cathode 30 to induce a magneto-hydrodynamic stirring force, to the electrolyte 40. A motor 88 may be configured to turn the cathode lead 35 through a rotating mechanical seal 37 in the lid 60, thereby rotating the cathode 30 in the electrolyte 40 at, e.g., about 1 to 30 revolutions per second. Methods for agitating liquids such as the electrolyte 40 in a gas-tight enclosure such as the vessel 60 are known to those skilled in the art.

In an exemplary process sequence for electrowinning silicon from silicon dioxide in the system 10, the exterior circuit 65 includes a DC voltage supply. The system 10 is configured with a cylindrical single silicon crystal 3 cm in diameter as the cathode 30 and liquid silver in an YSZ tube 3 cm in outer diameter as the SOM anode 48. The anode lead 25 is illustratively a wire of a noble metal such as iridium. Each of the cathode 30 and the SOM anode 48 is about 30 cm long. The electrolyte 40 is about 80% calcium fluoride-magnesium fluoride eutectic, 10% silicon dioxide and 10% aluminum oxide by weight. The interior temperature of the vessel 60 is maintained at about 1000° C.

The motor 88 is operated to rotate the cathode 30 at about 10 revolutions per second. The voltage supply 90 is operated to apply a protective DC voltage between the anode 20 and the vessel 60. The applied protective voltage is illustratively too small to induce cathodic deposition from the electrolyte 40 onto the interior of the vessel 60 but sufficient to inhibit dissolution of the vessel 60 and prevent contamination of the electrolyte 40 in situ. The voltage supply 90 is optionally first operated to cause cathodic deposition of a coating of silicon from the electrolyte 40 onto the interior of the vessel 62 and thereafter apply the smaller protective voltage to maintain the coating.

Figure 2:
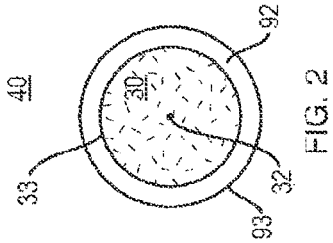
FIG. 2 is a sectional view of the cathode shown in FIG. 1, taken parallel to the lid of the electrowinning system.

The exterior circuit 65 is operated to impose a DC voltage between the cathode 30 and the anode 20 and thereby induce electrolysis of silicon dioxide in the electrolyte 40. Oxygen anions diffuse through the membrane 45 to the anode 20, where gaseous oxygen is formed, releasing electrons that pass to the exterior circuit 65. The gaseous oxygen exits the vessel 60 through the open end 74 of the tube. At the same time, electrons are delivered to the cathode 30 and through it to its interface with the electrolyte 40. With reference to FIG. 2, species in the electrolyte 40 are thereby reduced to deposit a solid material 92, a product comprising silicon, on the cathode 30 over the surface 33 behind a moving product-electrolyte interface 93. The deposited solid material 92 thereafter functions as part of the cathode 30.

Rotation of the cathode 30 around its axis 32 promotes uniform advancement of the interface 93 away from the axis 32 of the cathode 30, maintaining the original cylindrical symmetry of the cathode 30 as its diameter increases. Stirring the electrolyte 40 reduces concentration differences in the electrolyte 40 between the product-electrolyte interface 93 and other regions of the electrolyte 40 and promotes orderly incorporation of newly reduced material into the deposited solid material 92 at a high rate. Illustratively the deposit 92 is epitaxial silicon and at the end of deposition the cathode 30 is a single crystal of silicon. The thickness of the epitaxial deposit 92 may increase during electrolysis at a rate of, e.g., 75 μm/hour, 100 μm/hour, 250 μm/hour, 500 μm/hour or more. Deposition may be continued until the diameter of the cathode 30 is on the order of, e.g., 4 to 30 cm. The silicon in the deposited solid material 92 on the cathode 30 may be free of the impurities introduced by impure sources of carbon in conventional production of metallurgical grade silicon from its oxide and is furthermore obtained without the energy expenditure necessary for vapor-phase purification techniques.

Figure 3:
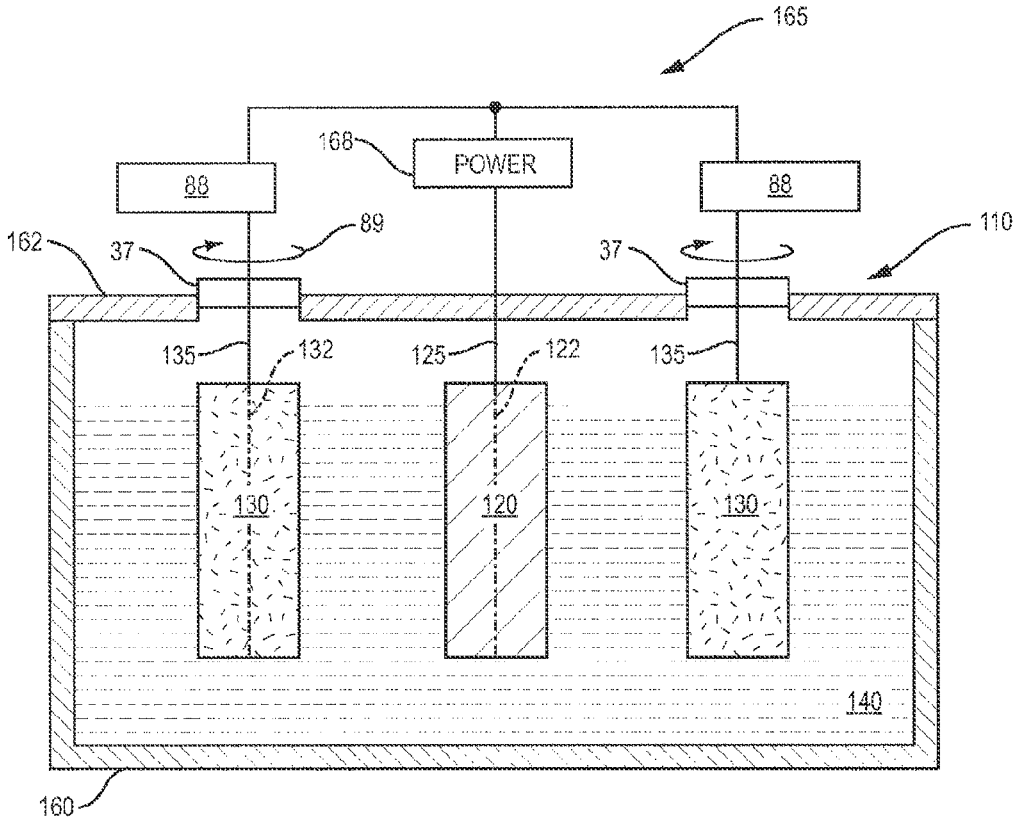
FIG. 3 is a schematic diagram of a high-cathodic-surface area electrowinning system compatible with the invention in which the vessel is shown in cross section.
Figure 4:
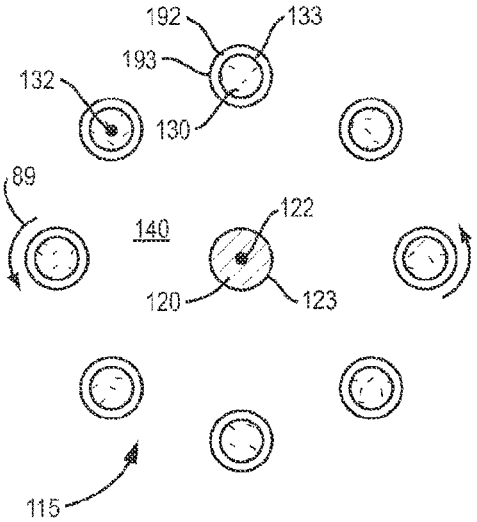
FIG. 4 is a sectional view of the electrodes of the system shown in FIG. 3 taken parallel to the lid.

In another embodiment, a system for electrowinning a target element from a feedstock compound is constituted for high productivity by delivering more deposited atoms per operating time and per batch of electrolyte loaded. With reference to FIGS. 3 and 4, in an illustrative embodiment, a high-cathode-area electrowinning system 110 includes a plurality of cathodes 130 arranged around an anode 120 in electrical contact with a liquid electrolyte 140 dissolving the feedstock compound. The cathodes 130 and the anode 120 together define a zone 115. A power supply 168 in an exterior circuit 165 is configured to receive electrons from the anode 120 through an anode lead 125 and to deliver electrons to each of the cathodes 130 through respective cathode leads 135 simultaneously. Each of the cathode leads 135 is configured with a stirring motor 88 as described for the lead 35 (FIG. 1) to the cathode 30.

The vessel 160, a lid 162, seals 37, and the exterior circuit 165 have properties and functions selected in view of the considerations described above for their counterparts in the silicon electrowinning system 10 (FIG. 1). The system 110 may be additionally or alternatively equipped with other features of the silicon electrowinning system 10.

The anode 120, the cathodes 130, and the liquid electrolyte 140 are constituted for suitability in electrowinning the target element in light of the considerations enumerated above regarding their counterparts 20 (FIG. 1) and 30 in the silicon electrowinning system 10. The anode 120 may be constituted as an SOM-type anode or be otherwise configured. The anode 120 has an axis 122 and a surface 123 in electrical contact with the electrolyte 140. The cathodes 130 have respective axes 132 and surfaces 133 in contact with the electrolyte 140. The total area of the surfaces 133 is greater initially, i.e., before electrolysis, than the area of the surface 123 of the anode 120. For example the total area of the surfaces 133 of the cathodes 130 in contact with the electrolyte 140 may initially be two, three, four, five, ten or more times the area of the surface 123 of the anode 120. Illustratively, the cathodes 130 are cylindrical bodies and eight in number.

In a variation, the anode 120 may be disposed along the axis of a single hollow cylindrical body (not shown) functioning in place of the cathodes 130. In this case, the interior surface of the cylindrical body is larger in area than the surface 123 of the anode 120 by several times. A stirring apparatus is operable to rotate the cylindrical body about the anode 120 to stir the electrolyte 140.

For a given number n of cathodes 130, the cathodes 130 are illustratively arranged around the anode with n-fold rotational symmetry, so that the cathodes are disposed at equal angular intervals around, and all at the same distance from, the anode 120. The stirring motors 88 may be configured to rotate all of the cathodes 130 in the same direction 89 as shown in the drawing. Alternatively, the stirring apparatus may be operated to rotate cathodes 130 at neighboring positions in opposite directions.

In operation of the system 110, the stirring motors 88 are operated to rotate all of the cathodes 130 simultaneously. While stirring is maintained, the power supply 168 is operated to electrolytically decompose the feedstock compound in the electrolyte 140 by inducing simultaneous oxidation at the anode 120 and reduction at the cathodes 130. A solid material 192, a product comprising the target element, is deposited simultaneously over each of the surfaces 133, becoming part of the respective cathodes 130. As operation of the system 110 continues, more of the target element accrues in the solid material 192 so that a product-electrolyte interface 193 advances into the electrolyte 140.

The high aggregate surface area of the cathodes in the system 110 enables the full current capacity of the anode 120 to be exploited without an undesirably high cathodic current density that might pass through a single cathode. For example, in the system 110 the cathodic current density may be on the order of 5% to 25% of the anodic current density. Lower cathodic current density promotes stability of the interfaces 193 and thus achievement of thicker deposits of the solid material 192 before local nonuniformities develop in the interfaces 193. Slower deposition may also enable impurity segregation to occur at the interfaces 193 to a greater degree. Accordingly the high aggregate cathodic areas support slower, more orderly growth of a purer solid material 192 constituting the target element product, with high system-wide productivity. The solid material 192 may be in the form of epitaxial deposits.

Candidate target elements for production as a solid phase by the system 110 include, e.g., silicon, tantalum, niobium, molybdenum, tungsten, scandium, titanium, vanadium, chromium, manganese, iron, cobalt, nickel, copper, neodymium, praseodymium, cerium, gadolinium, germanium, and beryllium. Configurations of the system 110 incorporating an SOM-type anode for the anode 120 are especially suited for producing target elements from oxide compounds.

In an exemplary process sequence, the high-cathode-area system 110 is configured to electrowin silicon from silicon dioxide. The electrolyte 140 is a mixture of fluorides, silicon dioxide and aluminum oxide maintained at about 1000° C. Each of the cathodes 130 and the anode 120 are constituted as the cathode 30 (FIG. 1) and the anode 20, respectively, described above for the exemplary process sequence for electrowinning silicon. The motors 88 are operated to rotate all of the cathodes 130 simultaneously at about 10 revolutions per second. The exterior circuit 165 is operated to induce decomposition of the silicon dioxide with deposition of silicon simultaneously onto the surfaces 133 of all the cathodes 130 in respective solid materials 192.

Figure 5:
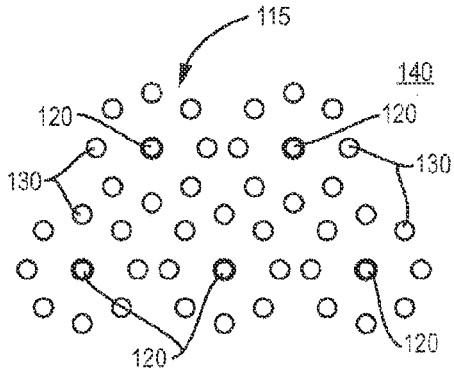
FIG. 5 is a sectional view of electrodes arranged in a plurality of zones in a high-cathodic surface area electrowinning system.

In a variation, with reference to FIG. 5, the high-cathode-area electrowinning system 110 includes several additional zones 115 tiled laterally in the electrolyte 140. All of the zones 115 in the system 110 are illustratively identical, and each is configured with an identical exterior circuit. The zones 115 are operable simultaneously to deposit the target element onto all of the cathodes 130 in all of the zones 115. A multi-zone high-cathode-area system may have, e.g., ten, twenty or thirty zones in a single vessel 160.

Figure 6:
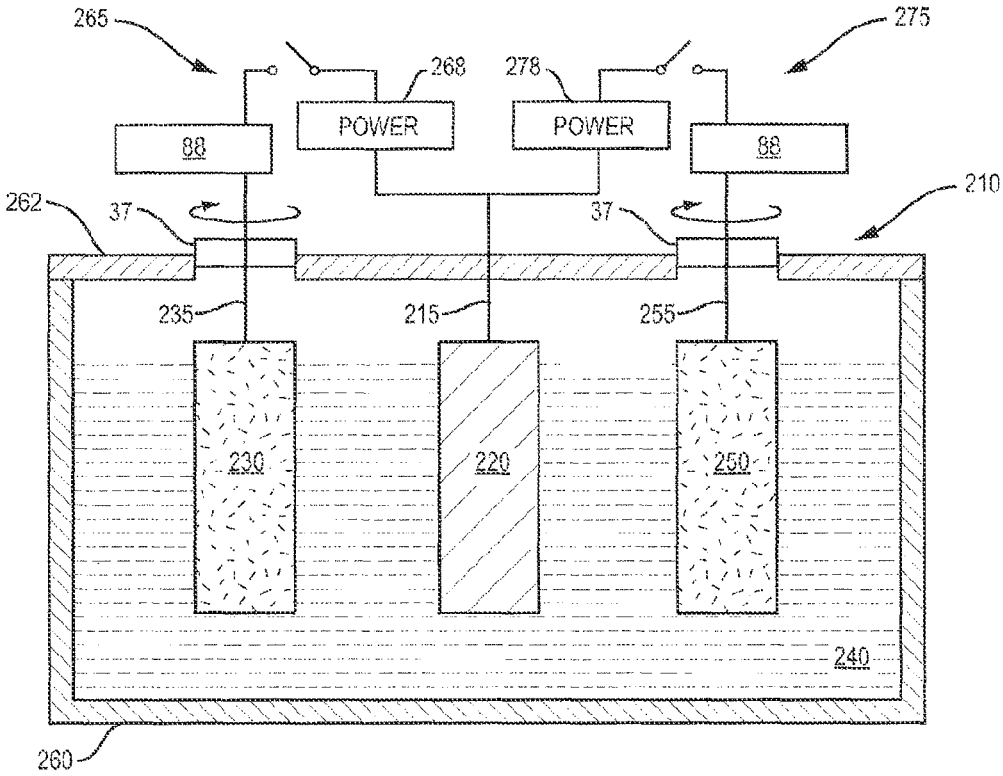
FIG. 6 is a schematic diagram of a high-purity electrowinning system compatible with the invention in which the vessel is shown in cross section.
Figure 7:
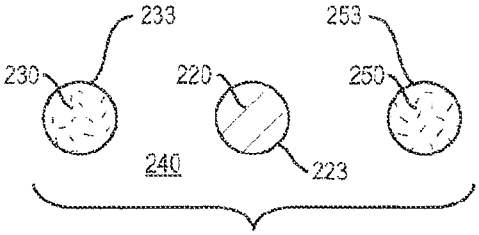
FIG. 7 is a sectional view of the electrodes shown in FIG. 6 taken parallel to the lid.

In another embodiment, an apparatus for electrowinning an element from a feedstock compound is constituted to produce a target element with substantial exclusion of impurities present in the feedstock compound or inherent in other components of the electrolyte. With reference to FIGS. 6 and 7, in an illustrative embodiment an impurity-segregating electrowinning system 210 includes an anode 220, a production cathode 230 and a preliminary cathode 250. The electrodes 220, 230 and 250 are in electrical contact with a liquid electrolyte 240, dissolving the feedstock compound, contained in a vessel 260. Candidate target elements for production by the system 210 may include those delineated above for the high-cathode-area electrowinning system 110 (FIG. 4).

The electrodes 220, 230 and 250 connect to constituents of the system 210 outside the vessel 260 through respective leads 225, 235 and 255. The lead 235 to the production cathode 230 and the lead 255 to the preliminary cathode 250 are each configured with a stirring motor 88 as described above for the lead 35 (FIG. 1) to the cathode 30. The electrolyte 240, the production cathode 230, a power supply 268 and the anode 220 form a production circuit 265. The power supply 268 in the production circuit 265 is configured to deliver electrons to the production cathode 230 and receive electrons from the anode 220. The electrolyte 240, the preliminary cathode 250, a power supply 278 and the anode 220 form a preliminary circuit 275. The power supply 278 in the preliminary circuit 275 is configured to deliver electrons to the preliminary cathode 250 and receive electrons from the anode 220. The power supplies 268 and 278 may be operable to impose DC voltages of constant, controlled values or to supply DC currents of constant, controlled values.

The vessel 260 and a lid 262 have properties and functions selected in view of the considerations described above for the vessel 60 (FIG. 1) and lid 62. The system 210 may be further equipped as described above with reference to the silicon electrowinning system 10. The anode 220 and the liquid electrolyte 240 are constituted for suitability in electrowinning the target element in light of the considerations enumerated above regarding the anode 20 and the electrolyte 40, respectively. The anode 220 is constituted to support an oxidation reaction that is part of the overall feedstock compound decomposition that occurs electrolytically during operation of the system 210. The anode 220 may be constituted as an SOM-type anode or be otherwise configured. The anode 220 has a surface 223 in electrical contact with the electrolyte 240.

The production cathode 230 is constituted to support a reduction reaction that is a component of feedstock compound decomposition occurring electrolytically during operation of the system 210 and to accumulate a solid deposit of the target element at relatively high purity. Accordingly, before electrolysis the production cathode 230 has a solid surface 233 that is conducive to deposition thereon of the target element, illustratively preferentially to other elements present in the electrolyte 240. For example, the composition of the production cathode 230 may be such that target element initially constitutes 50%, 70%, 90% or more of the production cathode 230 at the surface 233. Illustratively the cathode 230 begins as a cylindrical rod of the target element having a diameter of about 1 to 3 cm and a length on the order of 30 to 60 cm.

The preliminary cathode 250 is constituted to support one or more reduction reactions that are part of the decomposition of impurity-bearing compounds occurring electrolytically during operation of the system 210 and to accumulate a solid deposit of, thereby segregating, one or more impurities. Accordingly, before electrolysis the preliminary cathode 250 has a solid surface 253 that is conducive to deposition thereon of one or more impurity elements, illustratively preferentially to the target element. For example, the composition of the preliminary cathode 250 may be such that the target element initially constitutes no more than 50% or 70% of the preliminary cathode 250 at its surface 253.

The preliminary cathode 250 may be a cylindrical rod comprising, at a high concentration, one or more of the impurity elements contained in the feedstock compound or introduced by other components of the electrolyte 240. The preliminary cathode 250 may be of similar shape and dimensions to the production cathode 230.

Alternatively, the preliminary cathode 250 may be configured to promote a higher rate of impurity capture from the electrolyte 240. For example, the surface 253 on the preliminary cathode 250 may have an area before electrolysis that is equal to several times the area of the surface 233 of the production cathode 230 before electrolysis. In contact with the electrolyte 240, the large surface 253 may support an acceptable rate of electrolysis while maintaining low current density and, consequently, a thin boundary layer at the preliminary cathode 250. A design inducing a significant vertical component of electrolyte flow along the preliminary cathode 250 during electrolysis may furthermore increase impurity capture through improved compositional uniformity of the electrolyte 240.

Figure 8:
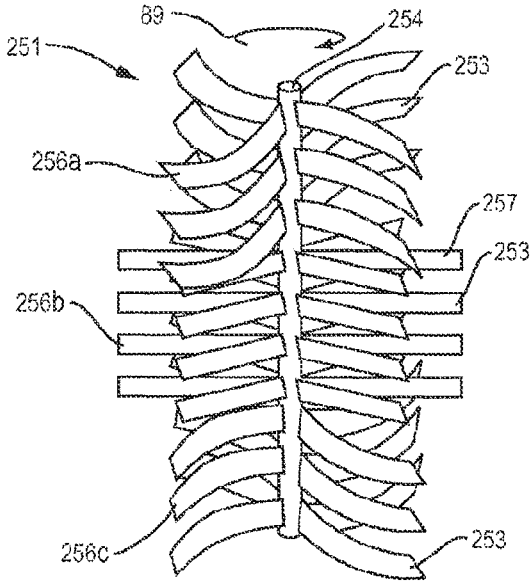
FIG. 8 is a perspective view of a high-capture preliminary cathode compatible with the system shown in FIG. 6.

With reference to FIG. 8, an illustrative high-capture preliminary cathode 251, suitable for use in the impurity-segregating system 210 as the preliminary cathode 250 (FIG. 6), has a cylindrical spine 254 about 30 cm in length. A plurality of vanes 256*a*, 256*b* and 256*c*, extending from the spine 254, in aggregate bear a high-area surface 253. The shape of the vanes 256*a*, 256*b* and 256*c* and their distribution around the circumference of the spine 254 may vary along the length of the spine 254, for example to induce downward flow of the electrolyte 240 through the vanes 256*a*, 256*b* and 256*c* during rotation of the cathode 251 in the direction 89. For example, upper vanes 256*a* may be contoured to draw the liquid electrolyte 240 toward the spine and downward. Middle vanes 256*b* may extend substantially radially from the spine 254 and be configured to further push the liquid electrolyte 240 downward. Lower vanes 256*c* may be contoured to push the liquid electrolyte 240 outward and downward.

The distal ends 257 of the respective vanes 256*b* illustratively trace a cylinder roughly equal in diameter to the ultimate diameter of the production cathode 230 bearing the target element product as described below. If the viscosity of the liquid electrolyte 240 is on the order of about 0.3 poise, the vanes 256*a*, 256*b* and 256*c* may be about 1 to 2 mm thick and 1 to 2 cm wide. If the viscosity of the liquid electrolyte 240 (FIG. 6) is on the order of 3.0 or more, as may be the case in a silicate-containing electrolyte, the vanes 256*a*, 256*b* and 256*c* may be about 3 to 5 mm thick and 3 to 5 cm wide. The illustrative high-capture preliminary cathode 251 may be manufactured by, for example, investment casting or powder metallurgy techniques.

The system 210 may be operable to hold either the production cathode 230 or the preliminary cathode 250 out of contact with the electrolyte 240 during operation. The vessel 260 is illustratively configured with sufficient headroom above the electrolyte 240 to allow alternate placement of cathode 230 or 250 into the electrolyte 240 and refraction of the placed cathode 230 or 250 partially or completely from the electrolyte 240 during operation of the system 210, without removing the lid 262. For example, the production cathode 230 and the preliminary cathode 250 may be positioned independently in the vessel 260 by threading their respective leads 235 and 255 through the seals 37 in the lid 262. In another approach, lid 262 may be configured to allow removal of an electrode 230 or 250 from the vessel 260 entirely without disturbing the lid 262.

In operation, the system 210 is first operated to electrodeposit one or more elements more electronegative than the target element onto the preliminary cathode 250. Electronegative impurity elements not desired in the product are thus segregated and localized on the preliminary cathode 250 and depleted from the electrolyte 240. After depletion the electrolyte 240 may include less than, e.g., 20%, 10%, 5%, 1%, or 0.5% of the reducible species bearing impurity elements initially present in the electrolyte 240. When the electrolyte 240 has been depleted, to an acceptable degree, of species bearing impurity elements, the system 210 is operated to electrolyze the feedstock compound remaining in the electrolyte 240, depositing the target element onto the production cathode 230. Thus the system 210 produces the target element at purity higher than that represented by the element in the feedstock compound first dissolved in the electrolyte 240.

Figure 9:
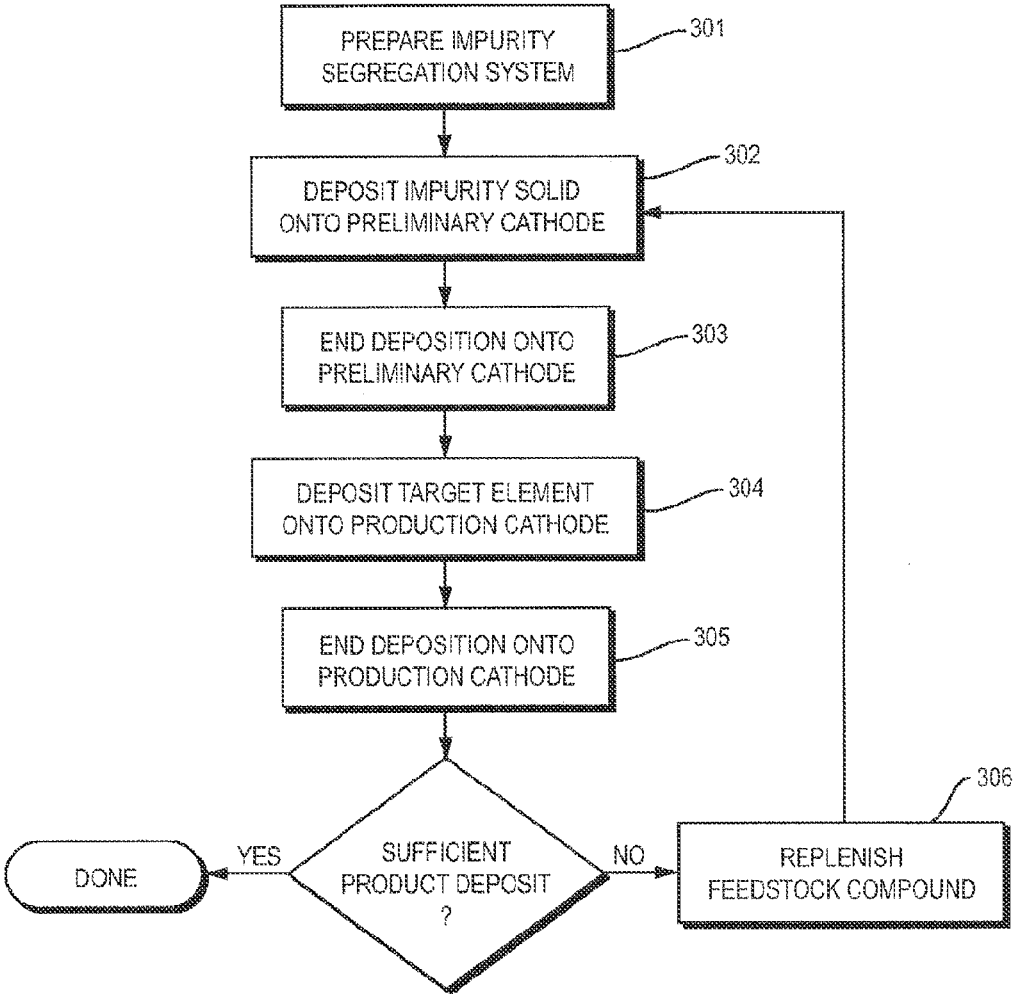
FIG. 9 is a flow diagram of an illustrative sequence, compatible with the invention, for depositing a target element at high purity in the system shown in FIG. 6.

FIG. 9 illustrates steps in an exemplary process sequence for depositing a product comprising a target element onto the production cathode 230 in the illustrative electrowinning system 210 at relatively high purity. With continuing reference to FIGS. 6 and 7, constituents of the system 210 are assembled as described above. (step 301) Illustratively, the electrolyte 240 is stirred during the process sequence by rotation of one or both of the cathodes 230 and 250 during deposition steps to promote compositional uniformity throughout the electrolyte 240 and reduce the importance of mass transfer effects in determining currents through the electrodes 230 and 250.

Figure 10:
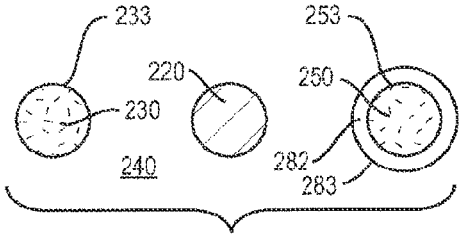
FIG. 10 is a sectional view of electrodes in the system shown in FIG. 6 after operation of the preliminary circuit.

With the production circuit 265 open, the preliminary circuit 275 is operated to provide electrons to the preliminary cathode 250 and to extract electrons from the anode 220, thereby electrolyzing one or more compounds, such as component oxides, in the electrolyte 240. Impurity elements borne by the compounds are deposited onto the preliminary cathode 250. (step 302) At the same time, species from the electrolyte 240 are oxidized at the anode 220. With reference to FIG. 10, as impurity-bearing species in the electrolyte 240 are reduced at the preliminary cathode 250, a solid material 282 accrues thereon over the surface 253 behind an advancing cathode/electrolyte interface 283 and thereafter functions as part of the preliminary cathode 250.

Deposition in the preliminary circuit 275 is continued until the electrolyte 240 is sufficiently depleted of impurities undesirable in the target element product. The point at which sufficient depletion has occurred may be, e.g., when on the order of 0.5%, 1%, 5%, 10%, 15% or 20% of the component oxide material in the electrolyte 240 has been deposited onto the preliminary cathode 250.

At sufficient impurity depletion, active electrodeposition onto the preliminary cathode 250 is stopped. (step 303) Thereafter the power supply 278 may be operated to impose a subelectrolysis voltage between the preliminary cathode 250 and the anode 220, thereby preventing net dissolution of the solid material 282. Alternatively the preliminary circuit 275 may be left open.

Figure 11:
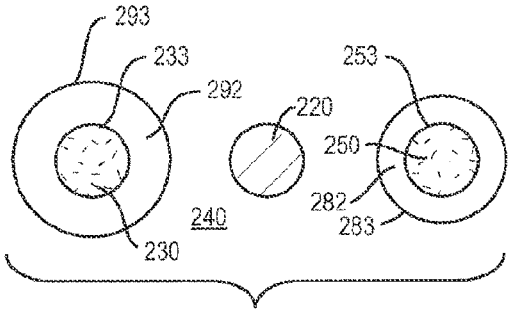
FIG. 11 is a sectional view of electrodes in the system shown in FIG. 6 after operation of the production circuit.

The production circuit 265 is operated to extract electrons from the anode 220 and to provide electrons to the production cathode 230, thereby electrolyzing the feedstock compound in the electrolyte 240. The target element is deposited onto the production cathode 230. (step 304) With reference to FIG. 11, a solid material 292, a product comprising the target element, accrues on the production cathode 230 over the surface 233 behind an advancing cathode/electrolyte interface 293 and thereafter functioning as part of the production cathode 230. The solid material 292 contains the target element at a desired high purity. Illustratively the target element constitutes at least 99%, 99.9%, 99.99%, 99.999%, or 99.9999% of the solid material 292 by weight. Target element deposition may continue until, e.g., the accumulated solid material 292 is of satisfactory mass, an impurity less electronegative than the target element begins to codeposit onto the production cathode 230 at an unacceptable rate, or the electrolyte 240 contains the feedstock compound at an undesirably low concentration.

Electrodeposition of the target element onto the production cathode 230 is stopped, for example by opening the production circuit 265. (Step 305) If additional target element mass is to be added to the deposited solid product 292, the feedstock compound may be replenished in the electrolyte 240 by introducing an additional increment of the compound (step 306). The illustrative process may then be reiterated beginning at step 302. A production cathode 230 beginning with a diameter of 1 to 3 cm may grow to be on the order of, e.g., 4 to 30 cm in diameter by the end of the process sequence.

In the second iteration of step 302 the preliminary cathode 250 used in the first iteration may be re-used. Alternatively, the preliminary cathode 250 may be replaced after one use by a new specimen having a fresh surface 253 with greater capability to incorporate impurities preferentially to the target element.

In a variation, step 302 is carried out with the production cathode 230 absent from the electrolyte 240. After step 302, the preliminary cathode 250 is withdrawn from, and the production cathode 230 inserted into, the electrolyte 240 before beginning step 304. Step 304 is then carried out with the preliminary cathode 250 absent from the electrolyte 240.

The operating parameters of the preliminary circuit 275 during step 302 may depend on the similarity of the electronegativities of the impurity elements in the electrolyte 240 and the target element. If the power supply 278 is operated to apply a DC voltage between the preliminary cathode 250 and the anode 220, the magnitude of the applied voltage is ideally chosen to induce relatively rapid deposition of electronegative impurities but no, or very limited, electrolysis of the feedstock compound. However, in general, segregation of electronegative impurities will occur with the sacrifice of some of the target element contained in the electrolyte 240, by its incorporation into the preliminary cathode 250. If the electrolyte 240 contains an impurity similar in electronegativity to the target element, so that the values $E_{eq}$ of the equilibrium electrode/electrolyte potentials of the impurity and the target metal differ by less than, e.g., 0.10 V, it may be difficult to localize the impurity at a significant rate by constant-voltage deposition without losing a significant fraction of the target element yield on the preliminary cathode 250.

The power supply 278 may instead be operated to provide a constant DC current to the preliminary circuit 275, allowing the voltage between the preliminary cathode 250 and the anode 220 to change as successively less electronegative impurities contribute to the current through the circuit 278. Voltage in the circuit 278 may be monitored in order to stop deposition in the preliminary circuit 278 (step 303) before significant loss of the target element onto the preliminary cathode 250.

During step 304, the power supply 268 may apply a DC voltage, between the production cathode 230 and the anode 220, that is identical to a DC voltage applied by the power supply 278 between the preliminary cathode 250 and the anode 220 during step 302. Alternatively, a larger voltage may be used in the production circuit 265 during step 304 than in the preliminary circuit 275 during step 302 because of differing discrimination capacities needed in the respective steps. In general, a larger current density, by a factor of two or more, in step 304 than in step 302 may provide a desirable product deposition rate while segregating impurities to an acceptable extent. In some cases, an optimal current density across the interface between the preliminary cathode 250 and electrolyte 240 may be no greater than 25% of the current density across the interface between the production cathode 230 and the electrolyte 240.

Better discrimination between the target element and less electronegative impurities may be effected in some cases using the power supply 268 to provide constant current. For a given element, at electrode/electrolyte potentials near the equilibrium value, a 1% change in the applied voltage may effect a 10% change in the electrolysis rate. Accordingly controlling current may render a better exclusion from the production cathode 230 of an impurity close in electronegativity to the target element.

In an illustrative embodiment, the target element is silicon and the anode 220, production cathode 230 and electrolyte 240 of the system 210 are constituted as described above for the SOM anode 48 (FIG. 1), cathode 30 and electrolyte 40, respectively. Before step 302, silicon illustratively includes no more than 50% of the preliminary cathode 250 at its surface 233. Initially the surface 253 of the preliminary cathode 250 is illustratively at least 50% iron. The preliminary circuit 275 may be operated during step 302 so that a potential E applied across the interface between the preliminary cathode 250 and the electrolyte 240 is larger than the equilibrium value $E_{eq}$ (1.52 V) for plating silicon but less than, around, or not much greater than the $E_{eq}$ for plating the impurity in the electrolyte 240 having the largest electronegativity less than that of silicon. In the case of silicon, this impurity may be titanium and the potential E applied may be illustratively equal to the value of $E_{eq}$ for titanium (1.60 V). Silicon may illustratively constitute less than 1%, 5%, 10%, 20% or less of the solid material 282 or 50%, 80%, 90% or more of the solid material 282.

Illustratively, after sacrificing on the order of less than 1% of the component oxides in the electrolyte 240 during step 302, silicon may be deposited at 99.9999% onto the production cathode 230 during step 304. The production circuit 265 illustratively may be operated during step 304 to impose a voltage effecting a potential E between the product cathode 250 and the anode 220 equal to 1.60 V or a voltage producing a larger potential, on the order of, for example, 1.75 V.

The presence of less electronegative impurities at significant levels in the silicon deposited onto the production cathode 230 may be avoided by stopping electrodeposition at around 90% to 95% oxides reduced. Thus, the process sequence delineated in FIG. 9 may yield silicon deposited onto the production cathode 230 corresponding to 90% or more of the silicon oxide feedstock in the electrolyte 240.

The electronegativity of boron is less than but close to the electronegativity of silicon. When silicon is to be electrowon in the system 210 from a silicon dioxide feedstock contaminated with boron oxide, the boron may be removed in a separate procedure before step 304 if necessary to the end use of the silicon. For example, when the electrolyte 240 is fluoride-based, as delineated above, passing an inert gas through the electrolyte 240 at the operating temperature of the system 210 may remove boron in the form of volatile boron trifluoride. Boron may constitute less than 0.01% or 0.001% by weight of a solid material 292 deposited onto the production cathode 230 after the electrolyte 240 is so treated to remove boron.

The process sequence in the system 210 may render better impurity segregation, with less loss of the target element onto the preliminary cathode 250, at lower operating temperatures. This factor may enter into the choice of the operating temperature of the system 210 in addition to those considerations described for the silicon electrowinning system 10.

Without being bound by any theory, considerations informing the choice of operating parameter values for steps 302 and 304 may be understood with reference to the respective cathodic currents contributed by deposition of the target element, silicon, and respective impurities onto the preliminary cathode 250 and the production cathode 230. Integrating the current through the preliminary circuit 275 due to deposition of an element during step 302 renders the quantity of the element accumulated in the solid material 282 and thus removed from the electrolyte 240. By considering the accumulation of all of the impurities present in the electrolyte 240 as a function of current passed through the circuit 275, the point of sufficient impurity localization on the preliminary cathode 250 may be determined. At this point deposition of the target element at high purity from the electrolyte 240 onto the production cathode 230 in the production circuit 265 becomes possible.

The cathodic current contributed by plating of one element may be described analytically using the Butler-Volmer equation $$i = i_o\left[\exp\left(\frac{(1-\alpha)nF}{RT}(E-E_{eq})\right) - \exp\left(-\frac{\alpha nF}{RT}(E-E_{eq})\right)\right].$$

known to those skilled in the art. The equation describes the variation of current density i due to an electrode reaction having an equilibrium potential $E_{eq}$ across an electrode-electrolyte interface. In the equation, for a given species in an electrolyte and its corresponding element deposited onto a cathode R is the ideal gas constant; F is Faraday's constant; $i_o$ is the exchange current density of the cation; n is its valence state; and a is a symmetry factor. The temperature T and the potential E applied across the electrode-electrolyte interface are operating parameters.

The evolution of a cathodic deposit was simulated for a silicon oxide feedstock containing typical impurities $Al_2O_3$ (0.156%), CaO (0.070%), $Cr_2O_3$ (0.020%), $Cu_2O$ (0.005%), $Fe_2O_3$ (0.079%), MgO (0.006%), Na20 (0.004%), $P_2O_5$ (0.042%), $TiO_2$ (0.023%), using concentrations figures provided by a tonnage supplier of $SiO_2$, and Additional oxides $SnO_2$, NiO, $K_2O$, ZnO, $ZrO_2$ and $B_2O5$ at 0.010% each. The stipulated silicon dioxide starting material is about 99.6% pure.

$E_{eq}$ for each oxide/element pair was calculated from the oxide free energy of formation ΔG at 1000° C. according to $\Delta G = -n\,FE_{eq}$. The $E_{eq}$ values are listed in Table 1.

TABLE 1

| Element | $E_{eq}$ V |
|---|---|
| Si | 1.52 |
| A1 | 2.00 |
| B | 1.42 |
| Ca | 2.40 |
| Cr | 1.24 |
| Cu | 0.40 |
| Fe | 0.85 |
| K | 0.77 |
| Mg | 2.23 |
| Na | 1.06 |
| Ni | 0.59 |
| P | 0.83 |
| Sn | 0.74 |
| Ti | 1.60 |
| Zn | 0.99 |
| Zr | 1.80 |

In support of the illustrative process sequence, a deposition model was developed wherein it was assumed that the electrolyte is perfectly mixed, the exchange current density $i_o$ for each species is directly proportional to its mole fraction in the electrolyte, and that an element will deposit only if $E > E_{eq}$. Using a value of 0.5 for a, at a selected operating temperature T and potential E, the Butler-Volmer current for each element/oxide pair in the simulated electrolyte was integrated using a variable-step forward-Euler algorithm with respect to the fraction of the total oxides reduced. For each integration step, the composition of the resulting deposit on the cathode was calculated and the composition of the electrolyte recalculated.

Figure 12:
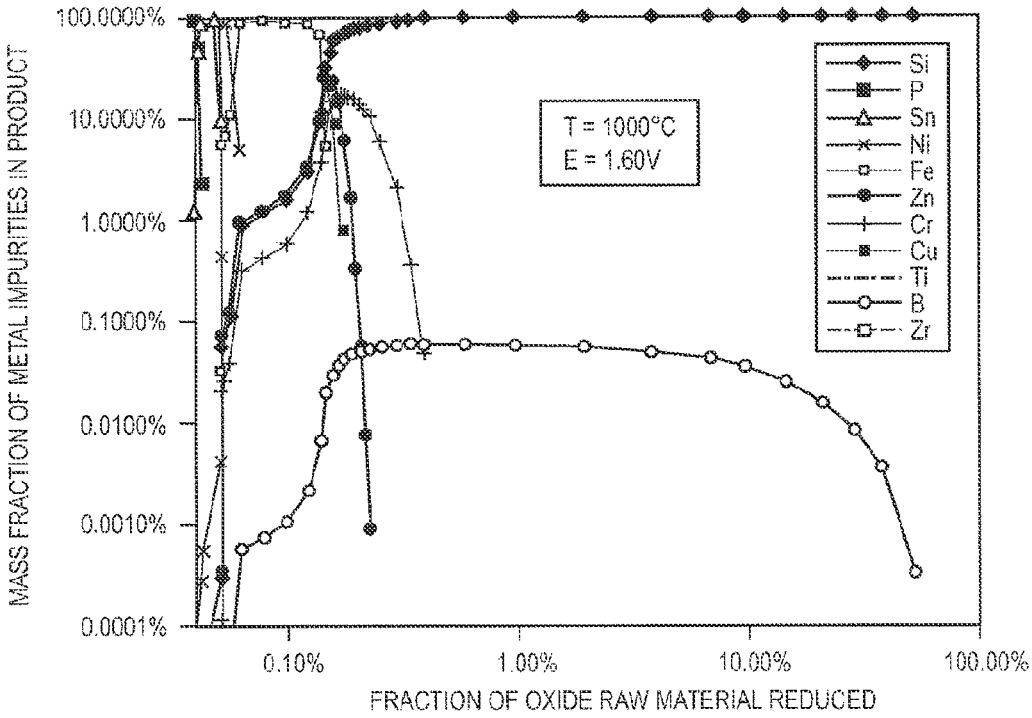
FIG. 12 is a graph demonstrating incorporation, at 1000° C. and 1.60 V, of impurity elements present in a hypothetical silicon oxide sample into a cathodic deposit.

FIG. 12 shows the deposit composition calculated as a function of the fraction of oxide material reduced for 1000° C. and E=1.60 V. Phosphorous plates onto the cathode first, followed by tin, nickel, iron, zinc, with chromium or copper being the last of the impurities more electronegative than silicon to be localized. Most of the more electronegative impurities plate out during reduction of the first 0.6% of all of the oxide matter present in the electrolyte. Boron continues to deposit after concentration of the electronegative impurities have decreased. The less electronegative impurities titanium and zirconium are not incorporated into the deposit at all.

Figure 13:
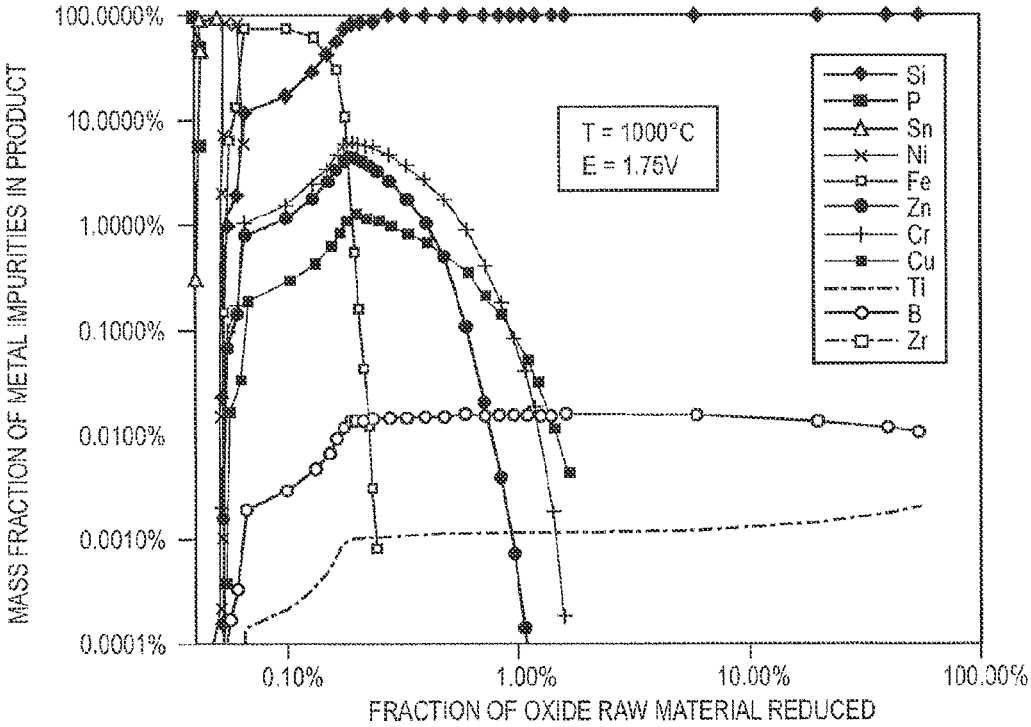
FIG. 13 is a graph demonstrating incorporation, at 1000° C. and 1.75 V, of impurity elements present in a hypothetical silicon oxide sample into a cathodic deposit.

By contrast, for E=1.75 V at the same temperature, the model shows silicon incorporated into the deposit more quickly by a factor of several hundred, as seen in FIG. 13. Relatively electronegative impurities are incorporated more slowly. For example, copper is still being incorporated at a significant rate at more than about 1% of the total oxides reduced. Boron and titanium are deposited. The concentration of titanium in the deposit increases over time.

Figure 14:
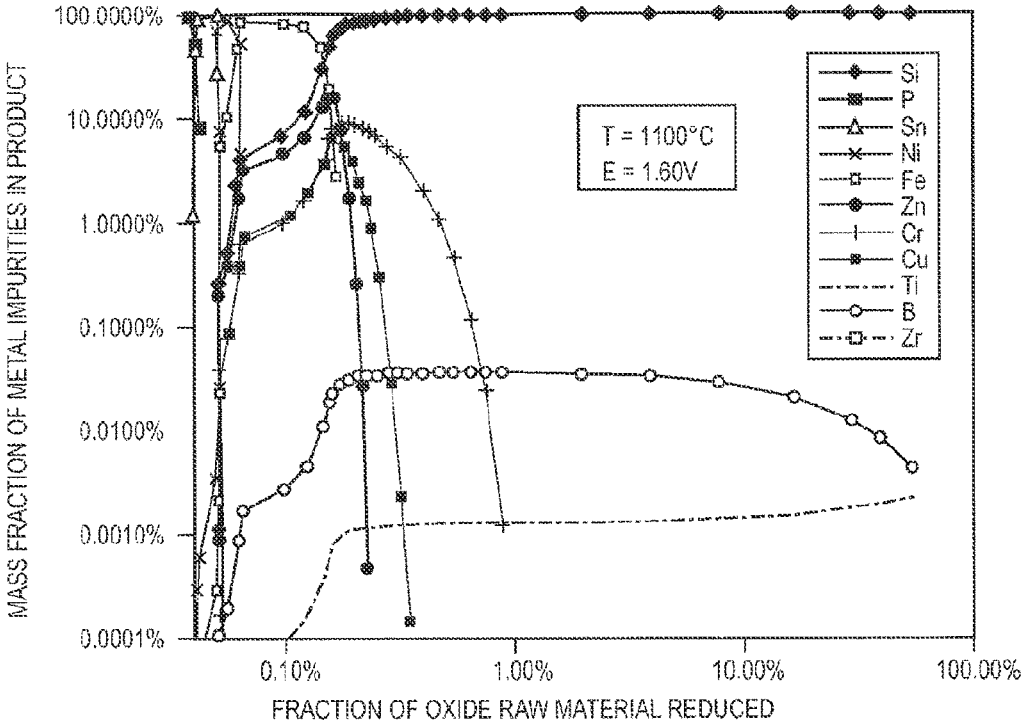
FIG. 14 is a graph demonstrating incorporation, at 1100° C. and 1.60 V, of impurity elements present in a hypothetical silicon oxide sample into a cathodic deposit.
Figure 15:
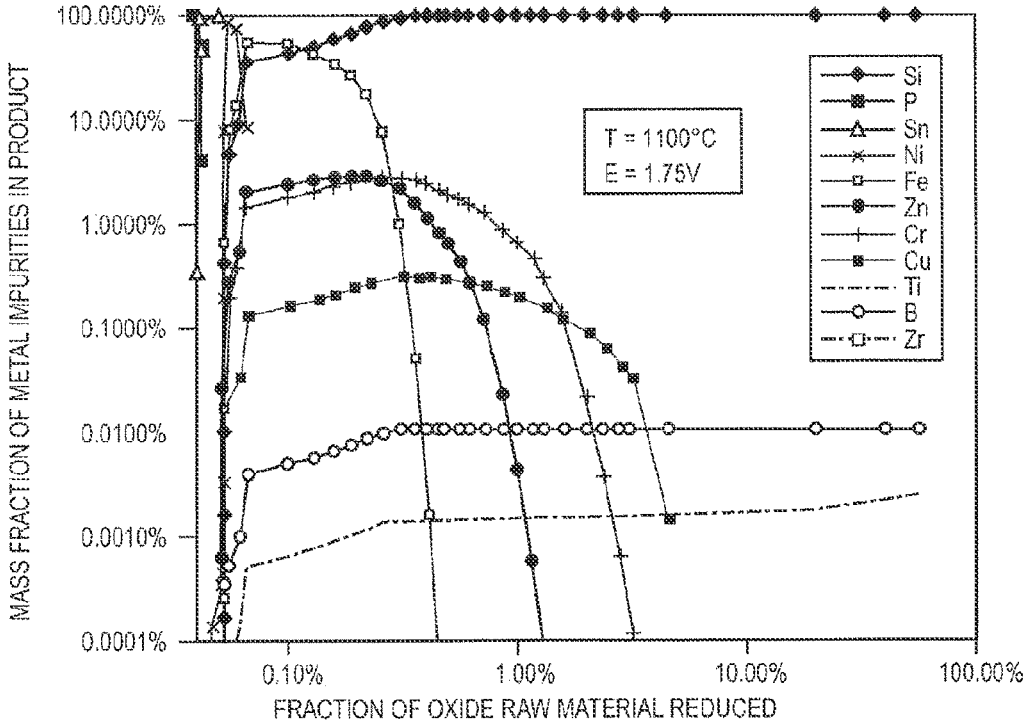
FIG. 15 is a graph demonstrating incorporation, at 1100° C. and 1.75 V, of impurity elements present in a hypothetical silicon oxide sample into a cathodic deposit.

FIGS. 14 and 15 show the deposit composition calculated as a function of the fraction of total oxides reduced at 1100° C. for E=1.60 V and E=1.75 V, respectively. Operation at the higher-temperature provides somewhat poorer differentiation between component elements. For E=1.60 V the electronegative impurities are not localized in a solid deposit until reduction of the first 1% of all of the oxide matter present in the electrolyte has occurred. However, plating occurs faster than at 1000° C.

Figure 16:
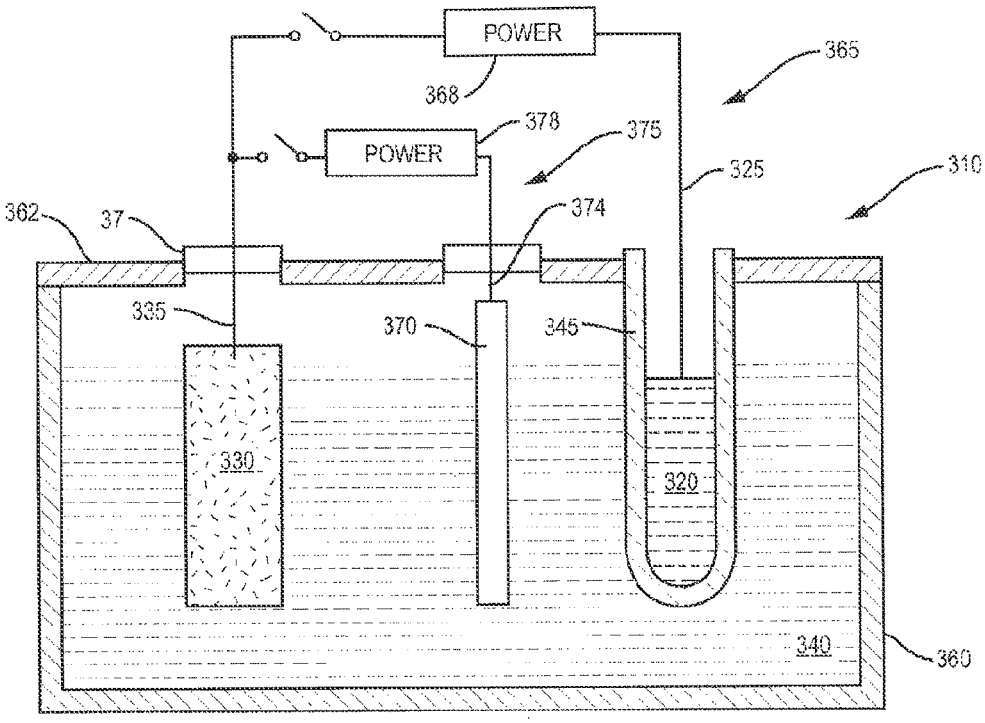
FIG. 16 is a schematic diagram of a dense-deposit electrowinning system, compatible with the invention with the vessel shown in cross section.

In another embodiment, a system for electrowinning a target element from a feedstock compound is constituted to produce a dense deposit of the target element with minimal porosity or electrolyte entrainment. With reference to FIG. 16, in an illustrative embodiment, a dense-deposit electrowinning system 310 is equipped with a counter cathode 370 interposed between an anode 320 and a production cathode 330. The electrodes 320, 330 and 370 are in electrical contact with a liquid electrolyte 340, dissolving the feedstock compound, contained in a vessel 360.

The electrodes 320, 330 and 370 connect to constituents of the system 310 outside the vessel 360 through respective leads 325, 335 and 374. The electrolyte 340, the production cathode 330, a DC power supply 368 and the anode 320 form a production circuit 365. The power supply 368 in the production circuit 365 is operable to supply electrons to the production cathode 330 and receive electrons from the anode 320.

The electrolyte 340, the production cathode 330, a DC power supply 378, and the counter cathode 370 form a dissolution circuit 375. The DC power supply 378 in the dissolution circuit 375 is operable alternately to supply electrons to the counter cathode 370 and receive electrons from the production cathode 330 and to drive the dissolution circuit 375 in reverse. The counter-cathode 370 is illustratively placed close to the anode 320 to effect electric field distributions of similar symmetry and opposite direction during respective operations of the production circuit 365 and the dissolution circuit 375.

Each of the leads 335 and 374 may be configured with a stirring motor 88 (FIG. 1) as described above for the lead 35 to the cathode 30. The vessel 360 and a lid 362 have properties and functions selected in view of the considerations described above for the vesse 160 and lid 62. The system 310 may be otherwise equipped as described above with reference to the silicon electrowinning system 10. The anode 320, production cathode 330 and liquid electrolyte 340 are constituted for electrowinning the target element from the feedstock compound in light of the considerations enumerated above regarding the anode 20 (FIG. 1), cathode 30 and the liquid electrolyte 40, respectively. The anode 320 is illustratively contained in a solid oxide membrane 345 as described above for the SOM anode 48. The counter cathode 370 is constituted to support a reduction reaction balancing an oxidation reaction electrodissolving deposited material from the production cathode 320.

Figure 17:
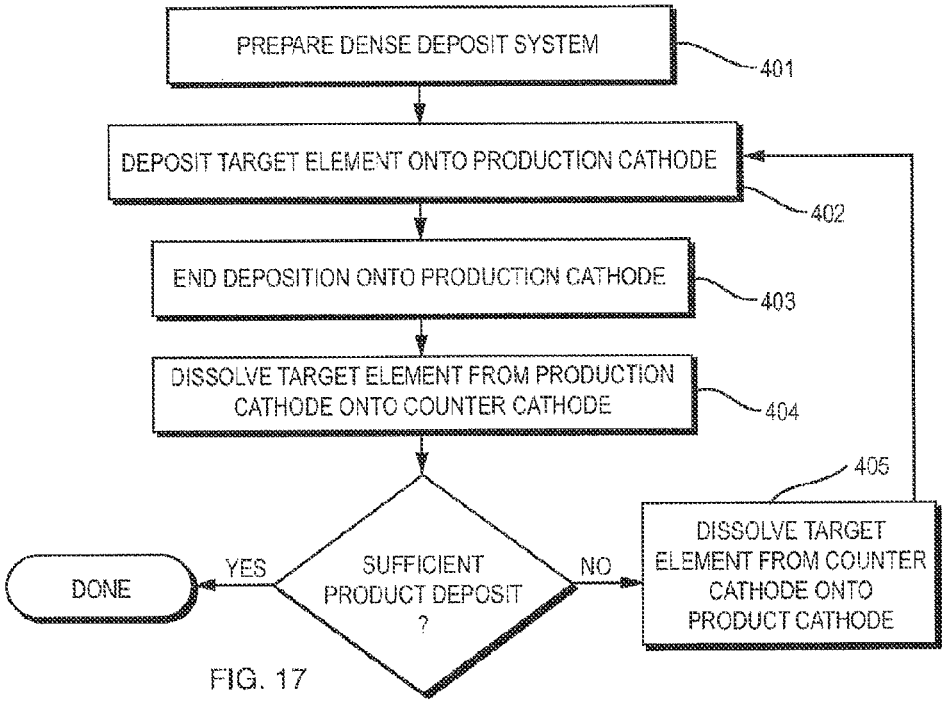
FIG. 17 is a flow diagram of an illustrative sequence, compatible with the invention, for producing a dense deposit of a target element in the system shown in FIG. 16.

FIG. 17 demonstrates steps in an exemplary process sequence for producing a dense deposit of a target element onto the production cathode 330 (FIG. 16) by executing a deposition-dissolution cycle in the illustrative dense-deposit electrowinning system 310. With continuing reference to FIGS. 16 and 17, constituents of the system 310 are assembled as described above. (step 401) Illustratively, the electrolyte 340 is stirred during the process sequence by rotation of one or both of the production cathode 330 and the counter cathode 370 during process time intervals.

Figure 18:
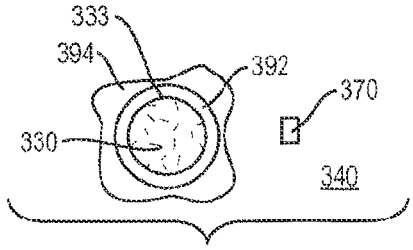
FIG. 18 is a sectional view of electrodes in the system shown in FIG. 16, taken parallel to the lid, after operation of the production circuit.

With the dissolution circuit 375 open, the production circuit 365 is operated to extract electrons from the anode 320 and to provide electrons to the production cathode 330, thereby electrolyzing the feedstock compound. With reference to FIG. 18, the target element is thereby deposited onto the production cathode 330 over a surface 333. (step 402) As species bearing the target element are reduced at the production cathode 330, a solid material 392 accrues thereon and thereafter functions as part of the production cathode 330. At the same time, species from the electrolyte 340 are oxidized at the anode 320 and leave the vessel 360. In a variation, step 402 is carried out with the counter cathode 370 absent from the electrolyte 340 to avoid, e.g., adventitious deposition onto or movement of the counter cathode 370.

Deposition in the production circuit 365 occurs throughout a deposition time interval. The solid material 392 deposited during the first part of the deposition time interval may be of uniform microstructure and density near 100% of the target element's value. The solid material 392 may constitute an epitaxial deposit on the production cathode 330. However, morphologically inferior material 394 deposited later in the deposition time interval may exhibit porosity, salt entrainment, dendrites or other undesirable surface features due to interfacial instabilities. The inferior material 394 is not acceptable as part of the target element product. At the end of the deposition time interval, active electrodeposition onto the production cathode 330 is stopped. (step 403) Thereafter the production circuit 365 is left open and the anode 320 electrically isolated.

Figure 19:
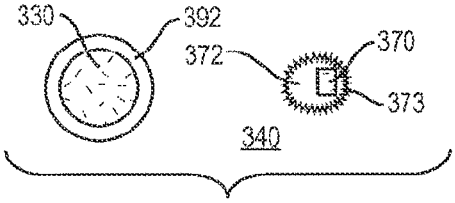
FIG. 19 is a sectional view of electrodes in the system shown in FIG. 16, taken parallel to the lid, after operation of the dissolution circuit.

With the production circuit 365 open, the dissolution circuit 375 is operated to extract electrons from the production cathode 330 and provide electrons to the counter cathode 370. A portion of the deposited target element, including all of the target element in the inferior material 394, is electrodissolved from the production cathode 330. Simultaneously, with reference to FIG. 19, atoms of the target element are cathodically deposited in a material 372 onto the counter cathode 370 (step 404).

During step 404 the production cathode 330 is functioning as an anode in the dissolution circuit 378. The counter cathode 370 provides a site for a reduction reaction that is part of an overall reaction including the oxidation of target element atoms previously deposited on the production cathode 330, during step 402. During deposition onto the production cathode 330 in step 402, oxidation reaction products formed at the anode 320 leave the system 310. Thus it is not straightforward thereafter to run the production circuit 365 in reverse to remove deposited material from the production cathode 330. The presence of the counter cathode 370 enables external control of the dissolution of the inferior material 394, through the power supply 378. Removal of the inferior material 394 restores an interface suitable for the product end use or onto which additional high-quality product can be deposited.

Dissolution in the dissolution circuit 375 is continued throughout a dissolution time interval, at least until the inferior material 394 has been removed from the production cathode 330. Illustratively, the deposition time interval is on the order of 2, 10, 100 or 200 times the dissolution time interval. At the end of the dissolution time interval, dissolution from the production cathode 330 is stopped. (step 405) The dissolution circuit 375 is thereafter left open.

Figure 20:
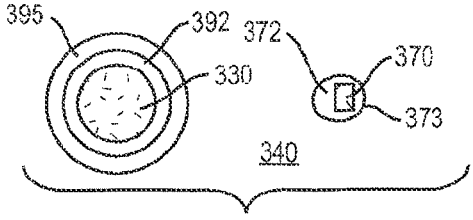
FIG. 20 is a sectional view of electrodes in the system shown in FIG. 16, taken parallel to the lid, after reverse operation of the production circuit.

In general the material 372 on the counter cathode 370 has rough surface features 373 that may limit its efficacy in further iterations of step 404. Accordingly, with reference to FIG. 20, the dissolution circuit 375 may optionally be operated in reverse to reduce surface roughness by electrodissolving atoms from the material 372 on the counter cathode 370 thereby removing the rough surface features 373. (step 405) At the same time a layer 395 of dense material containing the target element is added to the production cathode 330 over the solid material 392 by cathodic deposition, adding to the target element product. Step 405 also prevents the counter cathode 370 from accumulating considerable material and reducing the overall process yield of the target element at the production cathode 330.

If additional mass of the target element is to be added to the product over the deposited solid material 392 and the layer 395, the process may be reiterated beginning at step 402. By periodic removal of inferior material 394, the dense-deposit electrowinning system 310 allows significant accumulation of high-quality product on the production cathode 330.

Constituents or aspects of two or more of the systems 10 (FIG. 1), 110 (FIG. 4), 210 (FIG. 6), and 310 (FIG. 16) may be combined for greater productivity and/or product quality. With continuing reference to FIG. 6, in one approach, the impurity-segregation system 210 may be configured with a plurality of production cathodes 230 and a plurality of preliminary cathodes 250 (FIG. 8) to achieve the high-cathode-area advantage of the system 110 while electrowinning the target element at high purity. Electrowinning in such a hybrid system is carried out as delineated in FIG. 9, on several cathodes simultaneously. The preliminary cathodes 250 in such a hybrid system are illustratively disposed around the anode 220 analogously to the arrangement of the cathodes 130 around the anode 120 shown in FIG. 4. The production cathodes 220 may be disposed, e.g., in the electrolyte between respective pairs of sites occupied by the preliminary cathodes 250 during step 302. The preliminary circuit 275 and the production circuit 265 are configured to address simultaneously a plurality of preliminary cathodes 250 and production cathodes 230, respectively.

Figure 21:
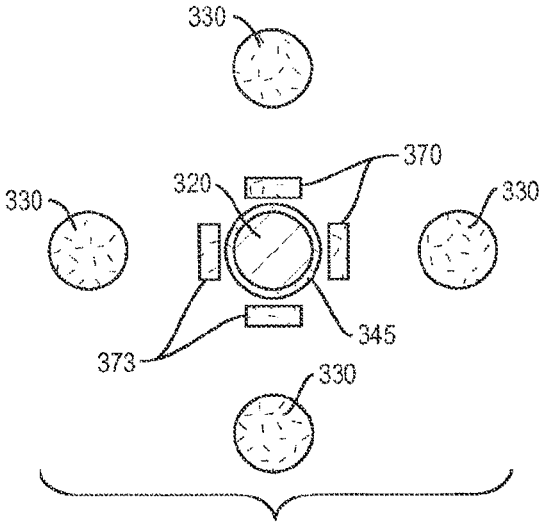
FIG. 21 is a sectional view of electrodes in a dense-deposit electrowinning system equipped with multiple cathodes and counter cathodes.

Similarly, the dense-deposit electrowinning system 310 (FIG. 16) may be configured with a plurality of production cathodes 330 and a plurality of counter cathodes 370 to achieve the high-cathode-area advantage of the system 110 while producing the target element in dense deposits by the process sequence shown in FIG. 17. The production cathodes 330 are illustratively disposed around the anode 320 analogously to the arrangement of the cathodes 130 around the anode 120 shown in FIG. 4. With reference to FIG. 21, the counter cathodes 370 may be disposed in a ring around the anode 320 during step 405. The counter cathodes 370 may be equal in number to the production cathodes 320.

Furthermore, features of all of the systems 10 (FIG. 1), 110 (FIG. 4), 210 (FIG. 6), and 310 (FIG. 16) may be combined in an electrowinning system to produce volume silicon in dense, high-purity deposits. In the combined system, after impurities in the electrolyte have been segregated by electrodeposition, high-purity silicon is deposited onto a plurality of cathodes with periodic surface renewal by electrodissolution.

Such a combined system is illustratively equipped with a plurality of preliminary cathodes 250, production cathodes 230/330, and counter cathodes 370 for each anode 48. Operation of the combination system begins delineated in FIG. 9 for the impurity-segregating system 210. With reference to FIGS. 6 and 7, electronegative impurities inconsistent with the end use of the silicon product are first segregated by deposition onto a plurality of preliminary cathodes 250 (FIG. 8) as in step 302.

Step 304 (FIG. 9) and step 402 (FIG. 17) function as the nexus between the impurity-segregating and dense-deposit process sequences described above. Depositing high-purity silicon product 292 (FIG. 10) onto a plurality of production cathodes 230 as in step 304 is equivalent in the combination process to depositing high-quality silicon product 392 (FIG. 18) onto a plurality of production cathodes 330 as in step 402. After step 304/402, the combined process follows the sequence illustrated by FIGS. 16 to 20. The inferior material 394 over the high-purity silicon product 392 is dissolved with simultaneous deposition of silicon onto a plurality of counter cathodes 370 (FIG. 21) as in step 404. The deposition-dissolution cycle of step 402 to step 405 may be repeated until the silicon product on the production cathodes 330 is sufficient in mass. The feedstock silicon dioxide may be replenished (step 306, FIG. 9) and the high-purity, high-density, high-volume process iterated beginning at step 302.

Although specific features of the invention are included in some embodiments and not in others, it should be noted that individual feature may be combinable with any or all of the other features in accordance with the invention. Furthermore, other configurations are compatible with the described features. For example, for an n-cathode zone 115 (FIG. 4) in the high-cathode-area system 110 (FIG. 3), the exterior circuit 165 may be equivalently configured as n power supplies; or the circuits 265 (FIG. 6) and 275 of the impurity-segregating system 210 may be configured to operate with a single power supply instead of the discrete supplies 268 and 278.

It will therefore be seen that the foregoing represents a highly advantageous approach to electrowinning elements from feedstock compounds, particularly as dense deposits of high-purity silicon useful for photovoltaic devices. The terms and expressions employed herein are used as terms of description and not of limitation, and there is no intention, in the use of such terms and expressions, of excluding any equivalents of the features shown and described or portions thereof, but it is recognized that various modifications are possible within the scope of the invention claimed.

What is claimed is:

1. A method of electrowinning an element from a compound, comprising:

providing a liquid electrolyte, in which the compound is dissolved;

providing a cathode in electrical contact with the liquid electrolyte;

providing an anode separated from the liquid electrolyte by a membrane capable of conducting the ions from the electrolyte; and executing a deposition-dissolution cycle comprising:

extracting electrons from the anode while providing electrons to the cathode during a first interval, thereby depositing a solid product, the element constituting at least 99% of the deposited solid product, onto the cathode, and electrically isolating the anode while extracting electrons from the cathode and providing electrons to a counter cathode in contact with the liquid electrolyte during a second interval, thereby electrodissolving a portion of the deposited solid product from the cathode and plating solid material comprising the element onto the counter cathode.

2. The method of claim 1 wherein dendrites are removed from the deposited solid product on the cathode during the second interval.

3. The method of claim 1 wherein the counter cathode is interposed between the cathode and the membrane.

4. The method of claim 1 further comprising executing an additional deposition-dissolution cycle.

5. The method of claim 1 further comprising removing the counter cathode from contact with the liquid electrolyte before executing the additional deposition-dissolution cycle.

6. The method of claim 1 wherein the deposition-dissolution cycle further comprises, after the second interval, reversing the polarity of the potential difference applied between the cathode and the counter cathode, thereby electrodissolving plated solid material from the counter cathode.

7. The method of claim 1 wherein the length of the first interval is 2 to 200 times the length of the second interval.

* * * * *